US006155309A

United States Patent [19]

Berktold

[11] Patent Number: 6,155,309

[45] Date of Patent: Dec. 5, 2000

[54] SETTABLE WEFT CLAMPING AND SEVERING APPARATUS

[75] Inventor: Klaus Berktold, Rüti, Switzerland

[73] Assignee: Sulzer Textil AG, Rueti, Switzerland

[21] Appl. No.: 09/479,328

[22] Filed: Jan. 6, 2000

[30] Foreign Application Priority Data

Jan. 12, 1999 [EP] European Pat. Off. ..... 99810015

[51] Int. Cl.[7] ..... D03D 47/34; D03D 47/38

[52] U.S. Cl. ..... 139/450; 139/452; 139/434; 139/302

[58] Field of Search ..... 139/452, 450, 139/434, 302; 242/419.4

[56] References Cited

U.S. PATENT DOCUMENTS

| | | | |
|---|---|---|---|
| 4,040,452 | 8/1977 | Santucci . | |
| 4,054,159 | 10/1977 | Juillard . | |
| 5,002,098 | 3/1991 | Desmet et al. | 139/194 |
| 5,398,731 | 3/1995 | Schuster | 139/194 |
| 5,398,732 | 3/1995 | Zenoni et al. | 139/450 |

FOREIGN PATENT DOCUMENTS

| | | |
|---|---|---|
| 0129812A2 | 1/1985 | European Pat. Off. . |
| 0644286A1 | 3/1995 | European Pat. Off. . |
| 0816545A1 | 1/1998 | European Pat. Off. . |
| 1303453 | 1/1973 | United Kingdom . |

*Primary Examiner*—Andy Falik
*Attorney, Agent, or Firm*—Townsend and Townsend and Crew LLP

[57] ABSTRACT

An apparatus for severing a weft thread which is to be inserted into a shed comprises a clamping device with a stationary clamping part and a settable clamping part in order to hold back the weft thread and a severing device in order to sever the weft thread after release by the clamping device. The severing of different yarn types is ensured by means of a problem-free clamping of the weft thread in the thread clamp.

20 Claims, 4 Drawing Sheets

SETTABLE WEFT CLAMPING AND SEVERING APPARATUS

BACKGROUND OF THE INVENTION

The invention relates to an apparatus for the severing of a weft thread which is to be inserted into a shed and to a weaving machine with an apparatus of this kind.

In rapier weaving machines the weft thread travels from a supply bobbin via a plurality of operating units into the cloth and is held by the warp threads. For a respective subsequent weft insertion the relevant weft thread is presented to an inserting rapier and inserted by the latter into the shed, with the weft thread being severed at a time point which is determined by the machine control system. The known inserting rapiers have a thread clamp, the clamping force or clamping gap respectively of which is previously set. If the weft threads which are to be inserted have different thicknesses and/or if their surface nature is different, then the weft threads penetrate to different depths into the clamping gap of the thread clamp. This can have the result that the weft threads are not reliably clamped, i.e. held, or are even damaged. Since the weft threads are in each case severed at the same time within a weaving cycle in the known rapier weaving machines, it happens that a weft thread is, on the one hand, severed without a reliable holding in the clamping gap of the thread clamp and, on the other hand, a thin thread can be torn off even before it is severed by the severing apparatus. In the first case errors result in the insertion of the weft thread, so-called lost threads; in the other case the inserted weft thread can be too short and jump back into the cloth, which leads to weaving errors.

SUMMARY OF THE INVENTION

The object of the invention is to improve an apparatus for the severing of a weft thread which is to be inserted into a shed.

DESCRIPTION OF THE SPECIFIC EMBODIMENTS

Figure 1:
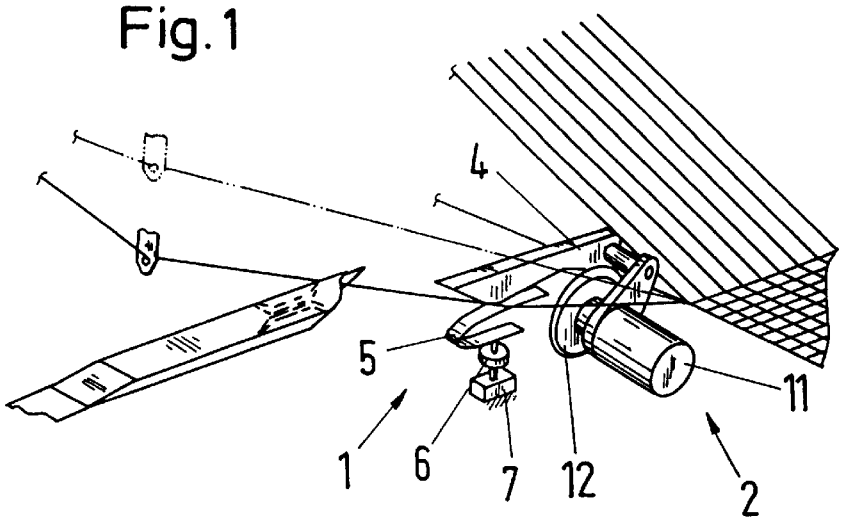
FIG. 1 is a perspective view showing a first embodiment of an apparatus in accordance with the invention in a spatial illustration.

Reference is made to FIG. 1, in accordance with which the apparatus consists substantially of a clamping device 1 and a severing device 2. The clamping device 1 contains a stationary clamping part 4, a leaf spring 5 and a setting screw 6. The stationary clamping part 4 is mounted at the severing apparatus and the leaf spring 5 lies at the one end in contact with the stationary clamping part and is connected at the other end to an end of the setting screw 6. The setting screw is rotatably arranged in a holder 7 so that the pressing force can be varied through rotation of the setting screw. The severing device 2 has a motor 11 and a knife 12 with a circular cutting edge, which is mounted on the motor axle. The stationary clamping part also forms a guide member in order to lead the weft thread towards the cutting edge.

Figure 2:
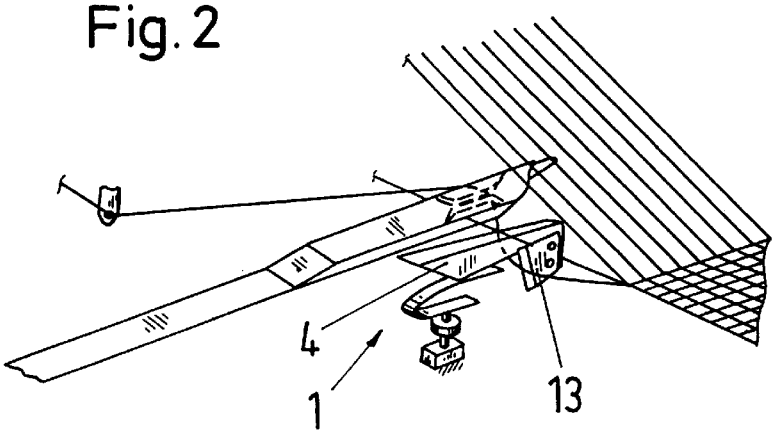
FIG. 2 is a perspective view showing a modification of the embodiment in accordance with FIG. 1.

As FIG. 2 shows, a knife 13, which is, e.g. mounted at the stationary clamping part 4, can be provided instead of the severing apparatus.

Figure 3:
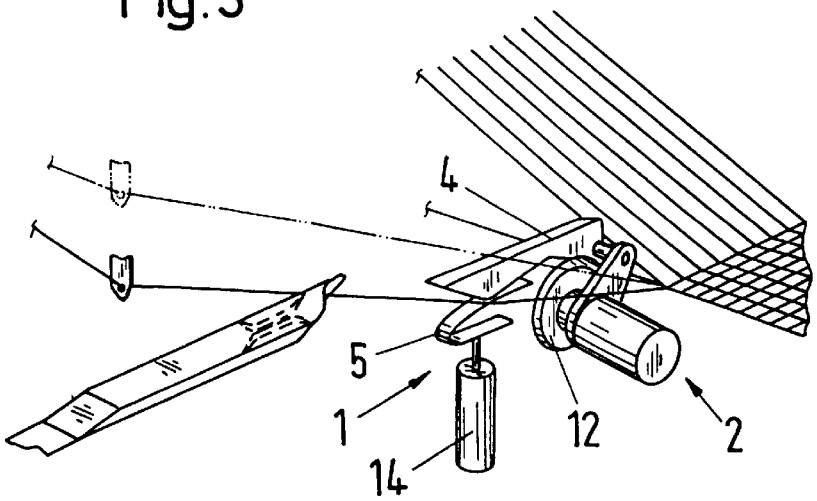
FIG. 3 is a perspective view showing a second embodiment of an apparatus in accordance with the invention in a spatial illustration.

As FIG. 3 shows, this apparatus differs from that in accordance with FIG. 1 in that a linear motor 14 is provided instead of the setting screw in order to vary the pressing force.

Figure 4:
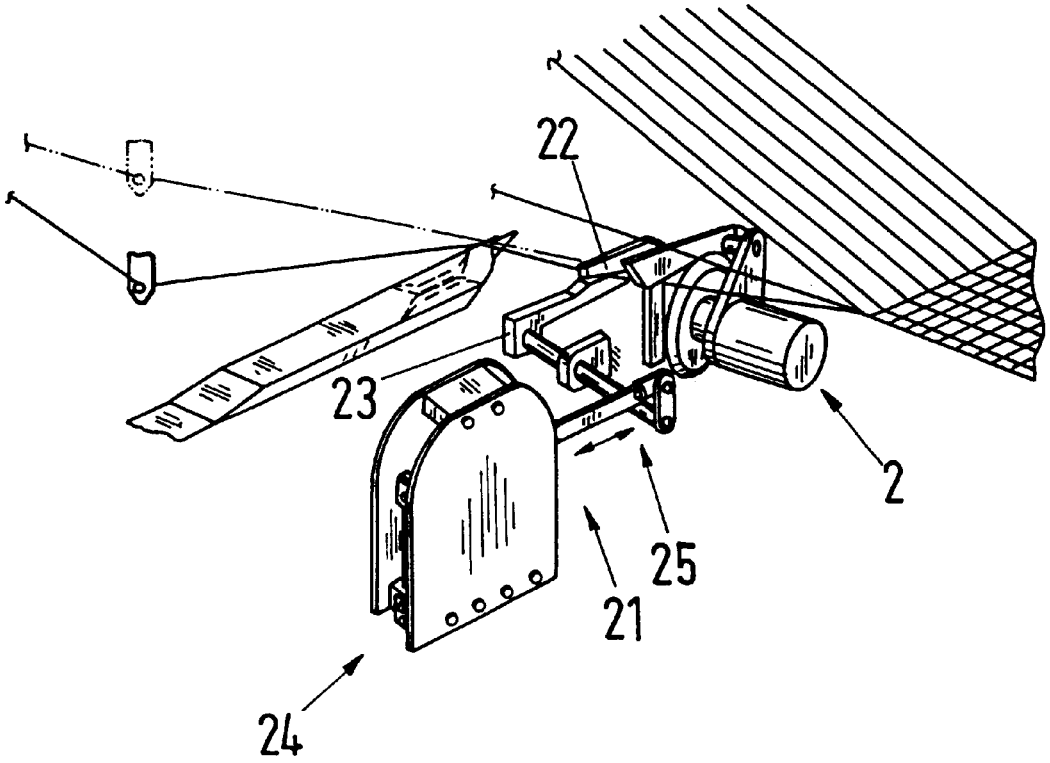
FIG. 4 is a perspective view showing a third embodiment of an apparatus in accordance with the invention in a spatial illustration.
Figure 5:
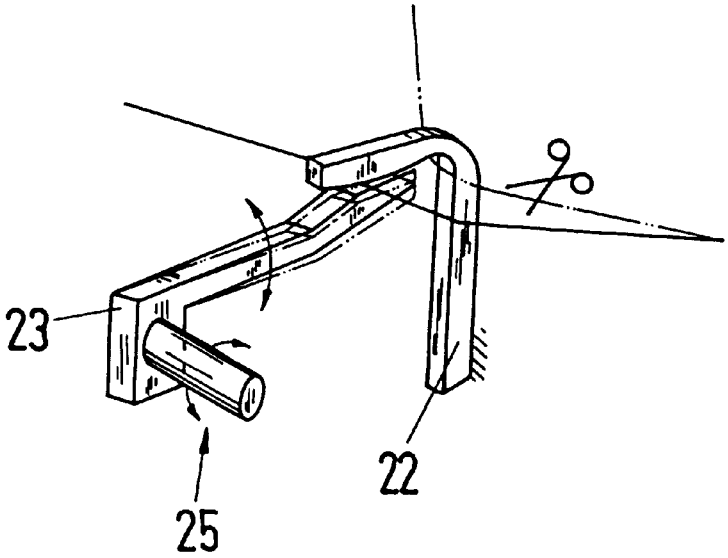
FIG. 5 is a perspective view showing a spatial illustration of the clamping device in accordance with FIG. 4 on an enlarged scale.

Reference is made to FIGS. 4 and 5. This apparatus contains the clamping device 21 and the severing device 2. The clamping device comprises a stationary clamping part 22, a movable clamping jaw or shoe 23 and a linear motor 24. The stationary clamping part 22 is stationarily arranged. The clamping shoe 23 is pivotally arranged with respect to the stationary clamping part 22 and is connected via mechanical transmission means 25 to the linear motor 24.

Figure 6:
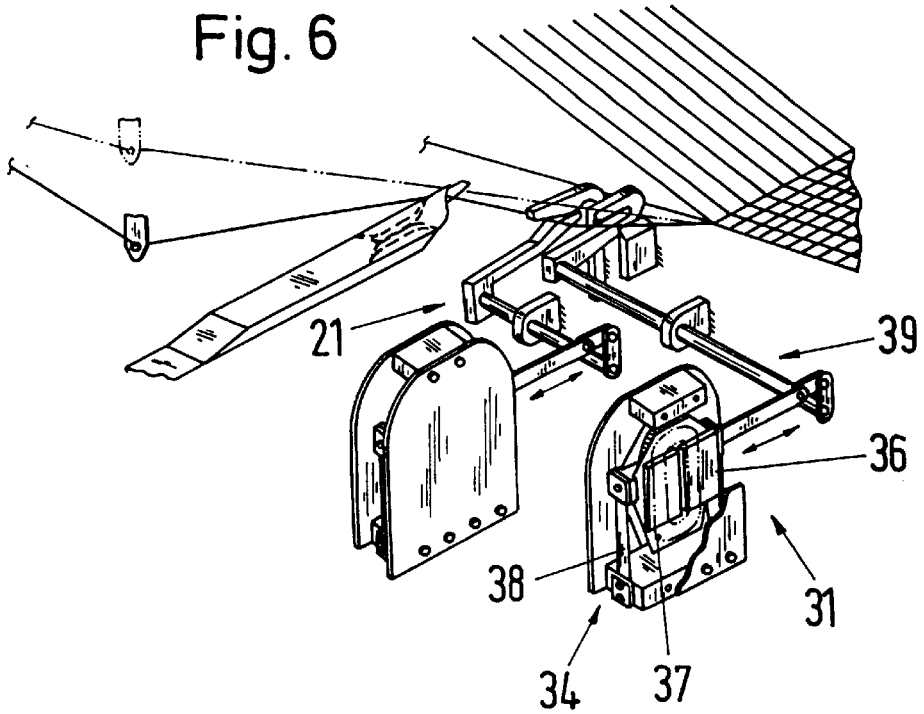
FIG. 6 is a perspective view showing a fourth embodiment of an apparatus in accordance with the invention in a spatial illustration.
Figure 7:
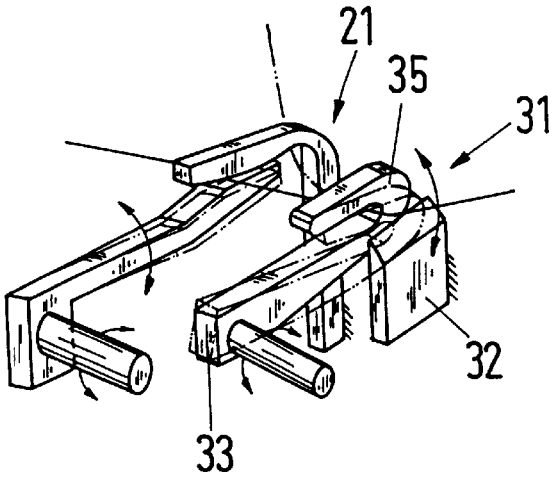
FIG. 7 is a perspective view showing a spatial illustration of the clamping device and the severing device in accordance with FIG. 6 on an enlarged scale.
Figure 8:
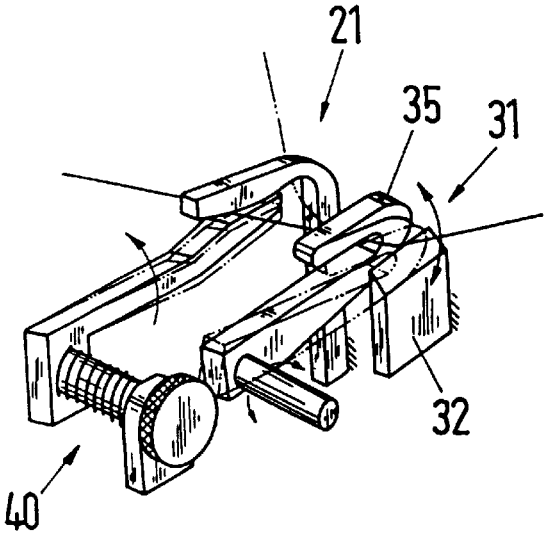
FIG. 8 is a perspective view showing a modified embodiment of the clamping device in accordance with FIG. 6

Reference is made to FIGS. 6 to 8. The apparatus comprises a clamping device 21 and a severing device 31. The severing device 31 contains a stationary knife 32, a movable knife 33 and a linear motor 34. The movable knife 33 contains a U-shaped section 35 in order to take up the weft thread and to displace it towards the cutting edge of the stationary knife. The linear motor 34 contains a stator 36, an armature 37 and two leaf springs 38 which serve as bearing parts for the armature so that the armature executes a straight line motion. The movable knife 33 is connected via mechanical transmission elements 39 to the armature of the linear motor 34. As FIG. 8 shows, a setting screw 40 can be used for setting the clamping force.

Figure 9:
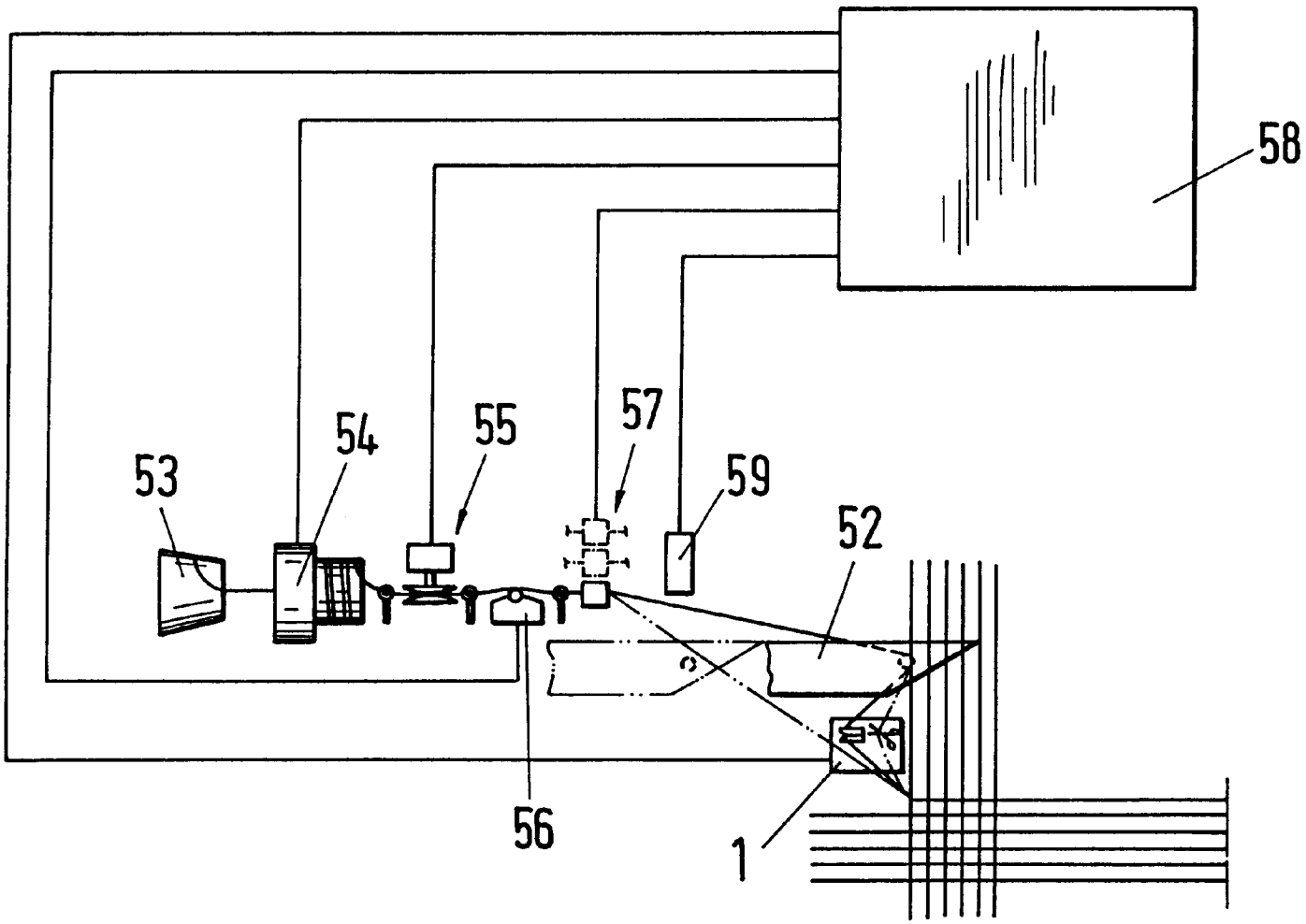
FIG. 9 is a perspective view showing a schematic illustration of an arrangement for the insertion of a weft thread by means of an inserting rapier.

FIG. 9 shows a schematic illustration of an arrangement for the insertion of a weft thread by means of an inserting rapier 52, which has a thread clamp. The arrangement comprises substantially a weft thread supply 53, a weft thread storage 54, a thread brake 55, a sensor 56 for the measurement of the thread tension, thread servers 57 as a part of a non-illustrated color selector, the apparatus 1 for the severing of the weft thread, a control device 58 and a signal generator 59, which emits a signal which is specific for the respectively presented weft thread.

In the following the function will be described with reference to FIGS. 1 and 9. During a weaving cycle a weft thread is displaced into the path of the inserting rapier 52 by means of the thread server 57. The weft thread is taken up by the thread clamp of the inserting rapier 52 and is forwarded in the direction of the shed. In this the weft thread is drawn into the clamping device 1 and is held back in the process. At this time point the motor 11 is switched on so that the knife 12 rotates. By holding back the weft thread by means of a clamp the weft thread is drawn into the clamping gap of the thread clamp of the inserting rapier. It is thereby achieved that the weft thread is reliably held in the thread clamp of the inserting rapier in dependence on the thread-specifically settable clamp 5 and that as a result, lost threads and cloth errors are avoided in an advantageous manner.

The apparatus comprises a clamping device with a stationary clamping part 4 and a settable clamping part 5 in order to hold back the weft thread and a severing device 2 in order to sever the weft thread after release by the clamping device 1.

The severing of different yarn types is ensured by means of a problem-free clamping of the weft thread in the thread clamp

What is claimed is:

1. An apparatus for severing a weft thread to be inserted into a shed, the apparatus comprising:

a clamping device including a stationary clamping part and a settable clamping part cooperating to hold back the weft thread with a clamping force, the settable clamping part being adjustable relative to the stationary clamping part to set the clamping force, and a severing device for severing the weft thread after release of the weft thread by the clamping device.

2. The apparatus of claim 1 wherein the settable clamping part comprises a leaf spring.

3. The apparatus of claim 2 wherein the leaf spring has an end in contact with the stationary clamping part and another end connected to an end of a setting screw which is adjustable to set the clamping force of the clamping device.

4. The apparatus of claim 1 wherein the settable clamping part comprises a clamping jaw or shoe which is pivotable with respect to the stationary clamping part.

5. The apparatus of claim 4 wherein the clamping jaw or shoe is connected via a mechanism transmission mechanism to a linear motor for adjusting the clamping jaw or shoe.

6. The apparatus of claim 1 wherein the clamping device further includes a setting mechanism which is connected with the settable clamping part and which is adjustable to set the clamping force of the clamping device.

7. The apparatus of claim 6 wherein the setting mechanism comprises a setting screw.

8. The apparatus of claim 6 wherein the setting mechanism comprises a linear motor.

9. The apparatus of claim 1 wherein the severing device comprises a stationary knife.

10. The apparatus of claim 1 wherein the severing device comprises a rotating knife.

11. The apparatus of claim 1 wherein the severing device comprises a stationary knife and a movable knife which is movable relative to the stationary knife, the movable knife including a section for holding the weft thread and displacing the weft thread toward the stationary knife.

12. The apparatus of claim 1 wherein the movable knife includes a U-shaped section for holding the weft thread and displacing the weft thread toward the stationary knife.

13. A weaving machine comprising an apparatus for severing a weft thread to be inserted into a shed, the apparatus having a clamping device including a stationary clamping part and a settable clamping part cooperating to hold back the weft thread with a clamping force, the settable clamping part being adjustable relative to the stationary clamping part to set the clamping force, the apparatus having a severing device for severing the weft thread after release of the weft thread by the clamping device.

14. The weaving machine of claim 13 wherein the settable clamping part comprises a leaf spring, the leaf spring having an end in contact with the stationary clamping part and another end connected to an end of a setting screw which is adjustable to set the clamping force of the clamping device.

15. The weaving machine of claim 13 wherein the settable clamping part comprises a clamping jaw or shoe which is pivotable with respect to the stationary clamping part, the clamping jaw or shoe being connected via a mechanism transmission mechanism to a linear motor for adjusting the clamping jaw or shoe.

16. The weaving machine of claim 13 wherein the clamping device further includes a setting mechanism which is connected with the settable clamping part and which is adjustable to set the clamping force of the clamping device.

17. The weaving machine of claim 16 wherein the setting mechanism comprises a setting screw or a linear motor.

18. The weaving machine of claim 13 wherein the severing device comprises a stationary knife or a rotating knife.

19. The weaving machine of claim 13 wherein the severing device comprises a stationary knife and a movable knife which is movable relative to the stationary knife, the movable knife including a section for holding the weft thread and displacing the weft thread toward the stationary knife.

20. The weaving machine of claim 19 wherein the movable knife includes a U-shaped section for holding the weft thread and displacing the weft thread toward the stationary knife.

* * * * *